United States Patent [19]

Bennett et al.

[11] Patent Number: 4,887,976

[45] Date of Patent: Dec. 19, 1989

[54] ELECTRICAL TERMINALS FOR FLAT POWER CABLE

[75] Inventors: Glenn E. Bennett, Glendale; John Kevin Daly; Robert K. Grebe, both of Scottsdale; John E. Lucius, Glendale, all of Ariz.

[73] Assignee: AMP Incorporated, Harrisburg, Pa.

[21] Appl. No.: 233,684

[22] Filed: Aug. 18, 1988

[51] Int. Cl.[4] ..... H01R 13/00

[52] U.S. Cl. ..... 439/492; 439/494; 439/862

[58] Field of Search ..... 439/284, 290, 291, 492, 439/494, 499, 861, 862

[56] References Cited

U.S. PATENT DOCUMENTS

| | | |
|---|---|---|
| 3,865,462 | 2/1975 | Cobaugh et al. . |
| 4,384,754 | 5/1983 | Douty et al. . |
| 4,405,189 | 9/1983 | Douty et al. . |
| 4,548,457 | 10/1985 | Derr . |
| 4,684,191 | 8/1987 | Feher et al. . |
| 4,737,115 | 4/1988 | Seidler . |

*Primary Examiner*—Joseph H. McGlynn
*Attorney, Agent, or Firm*—Anton P. Ness

[57] ABSTRACT

A monolithic transition adapter terminated to a flat power cable has one or two plate sections extending forwardly from the termination which conclude in an array of first and second alternating spring contact arms deflectable downwardly and upwardly respectively. The spring arms are formed to include free ends having arcuate contact sections convex in opposing directions comprising a lead-in to receive thereinto a blade-like contact member from forwardly thereof, and facilitating the deflection by the mating contact of the spring arms in the respective opposing directions. A monolithic contact member matable with the transition adapter includes a planar body portion having a forward blade contact and a plurality of terminal sections rearwardly thereof such as for interconnecting with a printed circuit board. In one such contact member the blade contact shares providing for an assured lead-in for mating by including a plurality of blade sections in an array of alternating first and second blades angled to define alternating downward and upward ramps to engage respective free ends of the transition adapter's spring arms and initiate the deflection of the spring arms in appropriate opposing directions for mating; this enables the vertical distance between the free ends of the deflected spring contact arms after mating to be minimized, reducing the vertical profile of the mated interface.

20 Claims, 6 Drawing Sheets

26
40
46
48
50
52
54
56
58
60
62
70
72
74
76
78
80
82
84
86
88
90
100
102
104
106
108
110
112
114
116

100
102
104
122
124
112
114
116
C
178
176
180
182
184
186
170
140
172

100
102
104
176
106
178
182
186
112
114
184
170
140
172

D
100
120
118
182
186
178
176
122
106
104
124
112
114
140
172
170

ELECTRICAL TERMINALS FOR FLAT POWER CABLE

FIELD OF THE INVENTION

The present invention is related to the field of electrical connectors and more particularly to electrical terminals for flat cable.

BACKGROUND OF THE INVENTION

U.S. patent applications Ser. Nos. 07/193,458 filed May 13, 1988 and 07/193,852 filed May 13, 1988, both assigned to the assignee hereof, disclose terminals and methods for terminating flat cable used for power transmission. The flat cable is of the type entering commercial use for transmitting electrical power of for example 75 amperes nominal and includes a single flat conductor coated with insulative material. One such cable provides a flat conductor one inch wide and about 0.020 inches thick with an extruded insulated coating of about 0.004 to 0.008 inches thick over each surface, with the cable having a total thickness averaging about 0.034 inches. The metal of the flat conductor is for example of Copper Alloy 110 and the insulation is for example TEFZEL thermoplastic resin known as polyethylene-co-tetrafluoro-ethylene copolymer (trademark of E. I. DuPont de Nemours and Company, Wilmington, Del.).

Application Ser. No. 07/193,458 discloses a different method of terminating such flat cable with integral means of a transition adapter member. Two opposing plate sections are hinged at a rearward cable-receiving end and have opposing termination regions; one of the plate sections extends forwardly from its termination region to a contact section. In each termination region is disposed a transverse array of wave-shaped crests extending toward the other plate section, alternating with relief recesses aligned with the wave-shaped crests of the other plate section, so that upon being pressed together against a cable end placed between the plate sections the wave-shaped crests having shearing edges will initiate a shearing of the cable. As the pressing together continues the crests will deflect the newly sheared cable portion out of the plane of the cable propagating the shear which will continue along the crest edges for a defined length until the plate sections are against the cable surfaces. A series of interlocking wave joints is thereby formed across the termination region, with a series of conductor strips of limited length deflected out of the conductor's plane but remaining integrally joined to the conductor. Copper inserts along the outside surfaces of the termination regions are now staked from their outer surfaces to deform the copper mass against the exposed newly sheared cable conductor edges and against the adapter's crest edges to establish an assured electrical connection through a series of gas-tight connections. The wave joints created by the wave-shaped crests may be staked to split the joints partially and provide spring compliance therein for the storage of mechanical energy prior to staking the inserts and thus provide an electrical interface resistant to stress relaxation and vibration.

The transition adapter includes any one of a variety of contact sections forwardly of the termination region for electrical connection with another electrical connector or article to transmit power and optionally to distribute power by means of a plurality of contact sections. Several types of contact sections are disclosed in U.S. patent application Ser. No. 07/050,793 filed May 14, 1987 and assigned to the assignee hereof.

It is desired to provide a separable interface between such transition adapter members terminated to flat power cable and mating contact members, to removably interconnect the power cable with an electrical system to be powered. U.S. patent application Ser. No. 07/169,514 filed Mar. 17, 1988 and assigned to the assignee hereof discloses a receptacle terminal for a separable interface for power interconnection. The terminal comprises a stamped and formed member having a pair of opposing plate sections joined by a lateral bight, and forwardly from the plate sections extend arrays of opposing spring arms together acting as a flared receptacle to receive therebetween a thick planar elongate bus bar. The bus bar engages contact sections of the spring arms and deflects the stiff spring arms outwardly and thereby generating sufficient contact normal force between the terminal and the bus bar. An apertured flange extending from a plate section provides for connection by a bolt fastener to a conventional ring tongue terminal terminated to a power cable. U.S. Pat. No. 4,684,191 discloses a similar terminal comprising two cast metal members defining a pair of apertured plate sections forwardly from which extend arrays of opposing contact arms The electrical terminal is connected to a conventional ring tongue terminal terminated a power cable, with an apertured planar contact element of the ring tongue terminal sandwiched between the pair of plates which are then secured thereto by a bolt fastener.

It is desired in particular to provide a separable interface between the flat power cable and a conventional printed circuit panel through a plurality of conventional board-mounted posts.

It is further desired to provide such a separable interface within a limited envelope to minimize the space occupied by the interface.

It is yet further desired to provide precise control over the resultant geometry and forces of the mated interface to assure the quality of the electrical performance across the interface during in-service use.

It is also desired to provide all of the above considerations using monolithic matable contact members.

SUMMARY OF THE INVENTION

The present invention provides a monolithic transition adapter terminated to a flat power cable and having an array of spring contact arms extending forwardly from the termination. The array comprises first and second alternating spring contact arms: the first spring arms are formed to include free ends having arcuate contact sections convex in a first direction; and the second spring arms are formed to include free ends having arcuate contact sections convex in a second direction opposed from the first direction. The array of alternating first and second free ends comprise a lead-in to receive there into a blade-like contact member from forwardly thereof, and facilitate the deflection by the mating contact of the first spring arms in the second direction and the second spring arms in the first direction. In one embodiment the spring arms all extend forwardly from a single plate section; in another, the spring arms extend forwardly from opposing plate sections.

The present invention also provides a particular monolithic contact member matable with the monolithic transition adapter of the present invention. The contact member includes a planar body portion, a plurality of blade sections extending forwardly therefrom in an array of alternating first and second blades having contact sections thereon to engage respective ones of the first and second spring arms of the transition adapter, and second contact means extending from the planar body portion to mate with corresponding contact means of another electrical article. The second contact means may be for example posts for insertion into holes of a printed circuit board for soldering, such as plated through-holes, or may be lands for surface mounting to pads of a printed circuit panel. The first and second blades conclude in first and second free ends angled to extend forwardly and outwardly from the plane of the planar body portion diverging from each other. The inwardly facing surface of each free end engages the convex surface of an arcuate contact section of a corresponding spring arm of the transition adapter upon mating to initiate the deflection of the spring arm. Providing a plurality of blade sections on the monolithic contact member having alternating angled forward ends can be said to divide the responsibility for necessary lead-in capability between the transition adapter and the contact member matable therewith. This divided lead-in responsibility minimizes the vertical distance between the forward ends of the first and second free ends of the first and second spring arms of the transition adapter otherwise necessary to provide an assured lead-in for mating with a blade-like contact member, resulting in a minimized low profile for the separable interface after spring arm deflection upon mating.

It is an objective of the present invention to provide a contact structure on a flat power cable terminal which is integral therewith.

It is also an objective to provide a flat power cable terminal matable with a blade contact in which opposing spring arms are deflectable by the blade in opposing directions without tending to pry apart opposing sections of the flat power cable terminal.

It is a further objective to provide a transition adapter having two plate sections, with an array of spring contact arms integral with a single plate section to eliminate dependence on precise termination technique to establish resultant precise tolerances along the free ends of the spring contact arms.

It is another objective of the present invention to provide a monolithic contact member having a plurality of contact sections for mating with a plurality of contact sections of another electrical article, to electrically interconnect the article and a flat power cable terminal to conduct electrical power.

It is yet a further objective to provide a monolithic contact member matable with a mating receptacle terminal having an array of spring contact arms deflectable in opposing directions, the monolithic contact member adapted to assist the overall lead-in requirements for mating the contact member and the mating receptacle terminal, and thereby reduce the vertical distance between the free ends of the deflected spring contact arms after mating, reducing the vertical profile of the mated interface.

It is an additional objective to provide matable transition adapter and contact members which can provide for polarization or simple keying if desired.

Embodiments of the present invention will now be discussed with reference to the accompanying drawings.

DETAILED DESCRIPTION OF THE PREFERRED EMBODIMENTS

Figure 1:
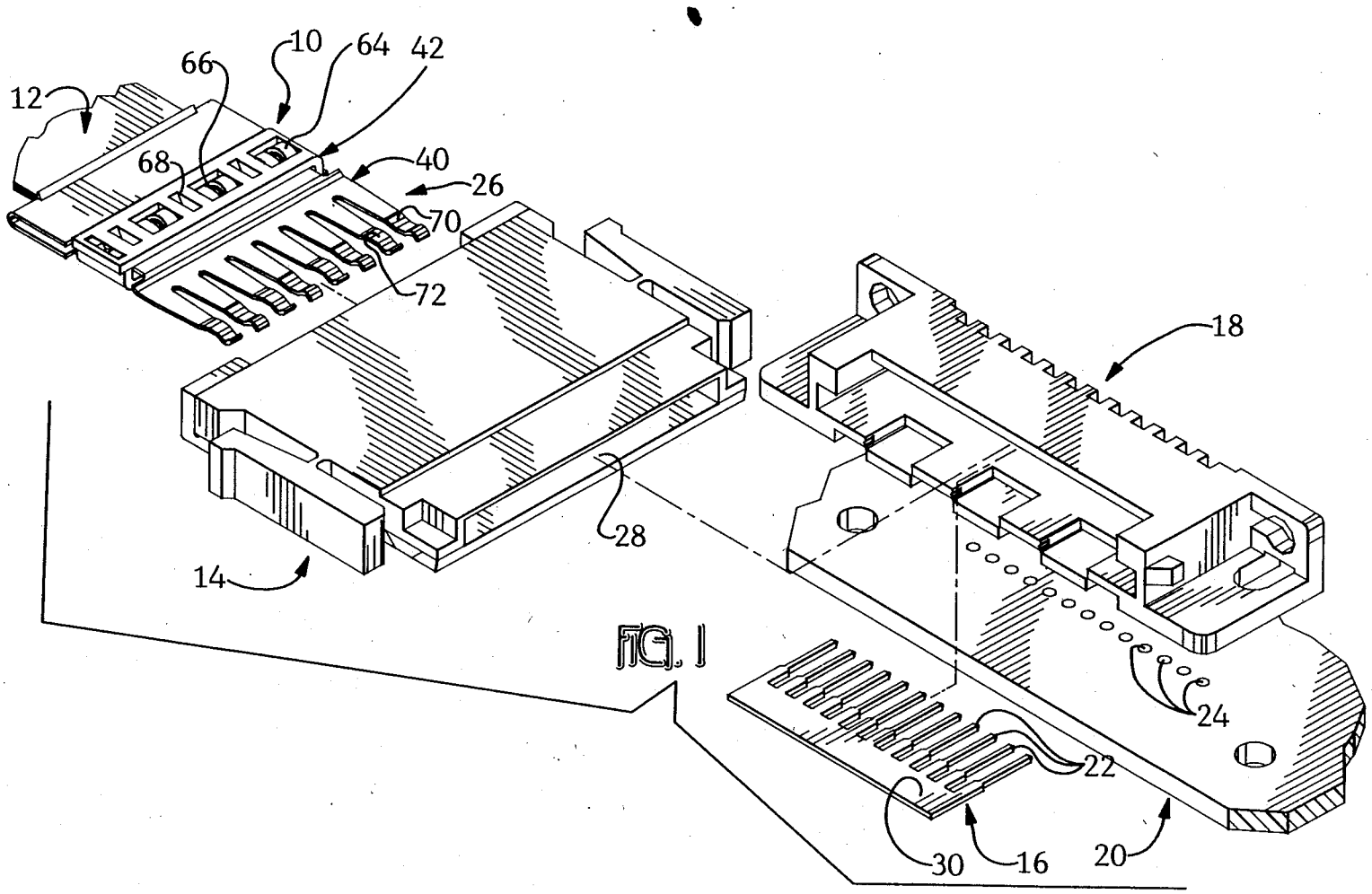
FIG. 1 is a perspective view of a first embodiment of transition adapter of the present invention terminated to a flat cable, a first embodiment of contact member of the present invention matable therewith, and housings exploded therefrom.

FIG. 1 illustrates a transition adapter assembly 10 terminated to a flat power cable 12, a dielectric housing 14 therefor, a blade-like contact member 16 matable with transition adapter assembly 10, a dielectric housing 18 for contact member 16, and a printed circuit panel 20 to which contact member 16 is to be electrically connected. Contact member 16 is shown to have a rearward contact region comprising a plurality of posts 22 extending rearwardly therefrom which after mounting in housing 18 will be bent at right angles to be inserted into corresponding holes 24 of printed circuit panel 20 and soldered. The contact member could also retain the posts rearwardly extending for vertical mounting, if desired, or for surface mounting could include horizontal lands on the post ends for soldering to conductive pads on the panel surface. Such an integral contact member is preferable to a plurality of separate terminals each having a post section and a forward contact section or region matable with corresponding contact sections on the transition adapter assembly, and not only simplifies manufacturing and assembly but is believed to yield substantially lower resistance than individual terminals because of the increased metal cross-section.

Housing 18 may be of the type disclosed in U.S. patent application Ser. No. 07,234,063 filed Aug. 18, 1988 and assigned to the assignee hereof. Housing 14 for transition adapter assembly 10 may be of the type disclosed in Ser. No. 07/234,063 comprising a plastic member having upper and lower cover sections hingedly joined at both ends of the mating face and latchable at the rearward or cable-receiving face after the transition adapter already terminated to flat cable 12 is placed between the upper and lower cover sections. Spring arms 70,72 of contact region 26 will extend forwardly within blade-receiving cavity 28 of housing 14 and comprise a receptacle to receive forward end 30 of contact member 16 therebetween upon mating.

Figure 2:
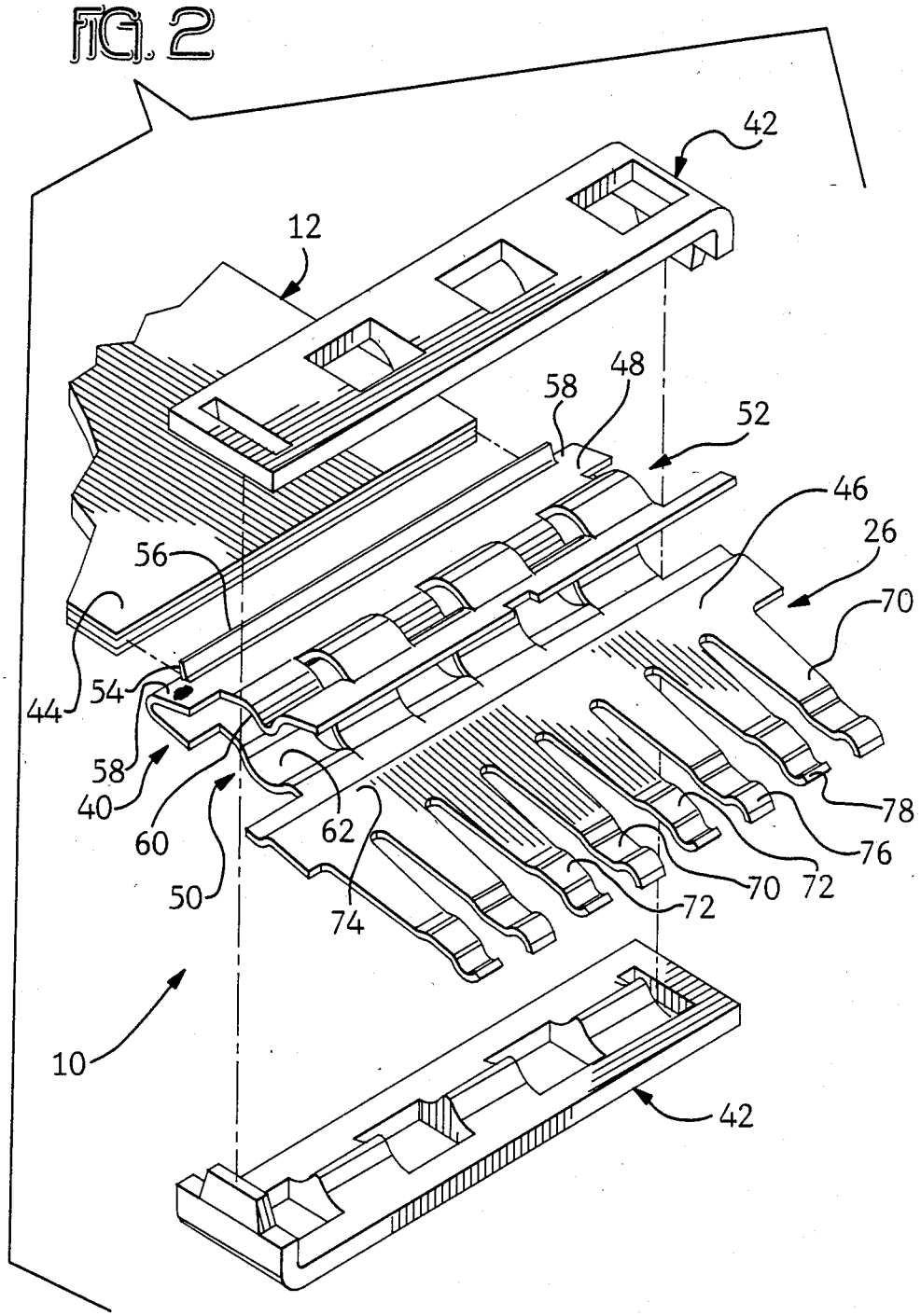
FIG. 2 is an exploded view of the transition adapter assembly.
Figures 3, 4, 6, 7:
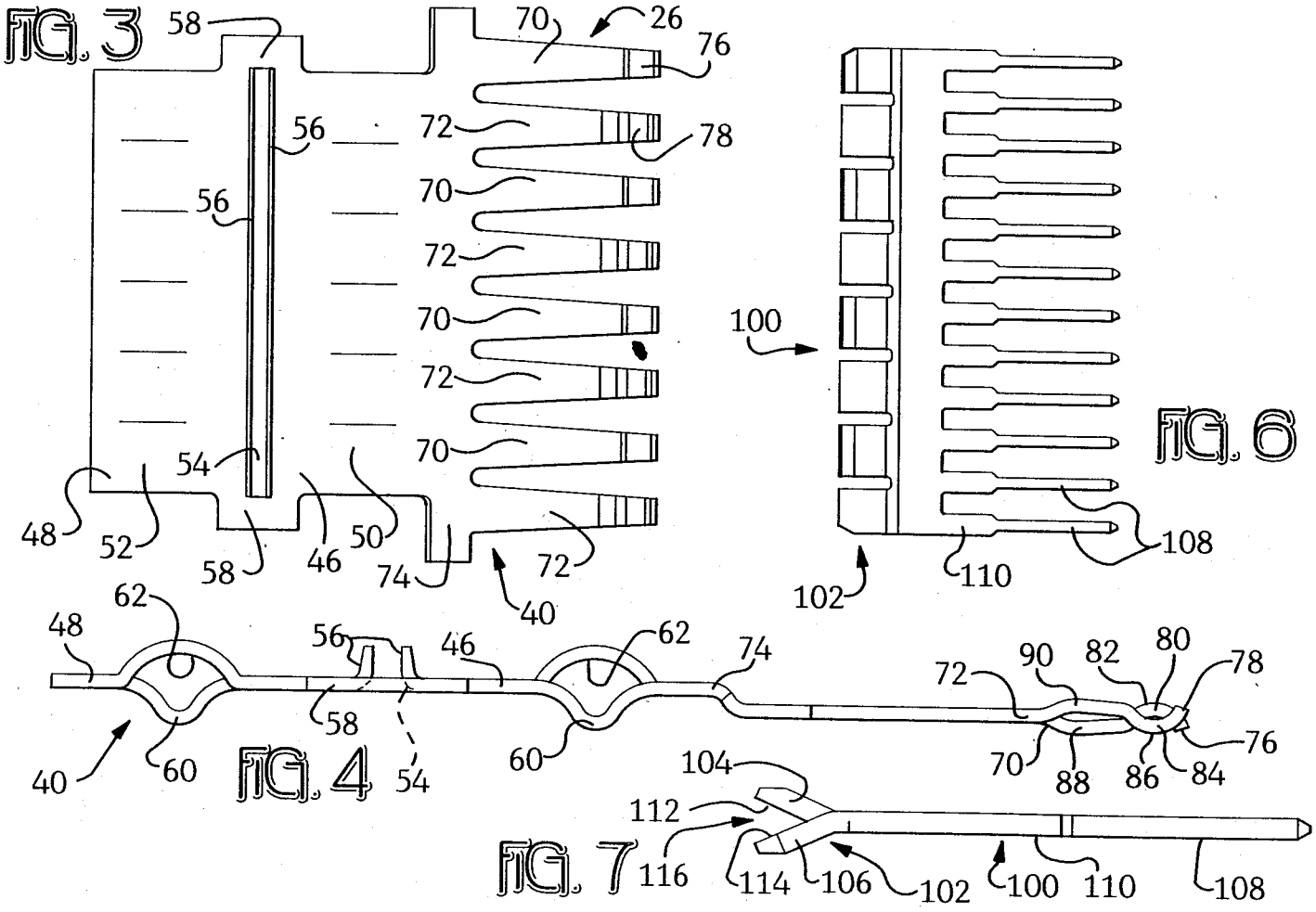
FIGS. 3 and 4 are a plan view and elevation view of the transition adapter of FIGS. 1 and 2 as stamped and formed.
FIGS. 6, 7 and 8 are a plan, enlarged elevation and perspective views of a second embodiment of monolithic contact member of the present invention.

Transition adapter assembly 10 is shown in more detail in FIG. 2, comprising a transition adapter 40 and a pair of insert members 42 all securable to an end 44 of flat power cable 12, or optionally to a lateral edge portion of a cable in a tapping arrangement, and the cable need not have its insulative coating removed prior to such termination. Transition adapter assembly 10 is of the type disclosed in Ser. No. 07/193,458 and Ser. No. 07/193,852. Referring to FIGS. 2 to 4, adapter 40 is an integral metal member stamped and formed to have a pair of plate sections 46,48 each having a termination region 50,52 for terminating to cable end 44, a cable-receiving slot 54 defined between upstanding strength members 56, hinge sections 58 joining plate sections 46,48 at both ends of slot 54, and contact region 26 extending from plate section 46 in a direction away from slot 54. Adapter 40 may be formed of for example Beryllium Copper Alloy 17410 of Brush Wellman Corporation about 0.016 inches thick with nickel underplating and silver plating thereover. Insert members 42 may be formed for example of dead soft CDA 110 copper, with nickel underplating and silver plating thereover. Insert members 42 preferably are secured to outer surfaces of plate sections 46,48; transition adapter is preferably then bent at hinge sections 58 until inner surfaces of plate sections 46,48 are almost together a cable thickness apart; cable end 44 is then inserted through slot 54 and forwardly until the forward end has passed the opposing termination regions 50,52 of plate sections 46,48; the plate sections 46,48 are then urged together with wave-shaped crests 60 of each plate section shearing alternate integral strips of the cable and urging them into relief areas 62 of the opposing plate section, forming an interlocking series of wave joints 64, as seen in FIG. 1. The wave joints 64 are then staked at 66 to provide the joints with compliance and provide a mechanism for storing energy, and further to trap and immobilize the deflected sheared conductor strips within the compliant halves of the wave joints. The inserts are then staked at 68 to enhance the electrical connections between the cable's conductor and the transition adapter 40 by the inserts 42, by storing energy in the now compliant wave joints 64. The transition adapter assembly and staking provides an assured termination of the flat cable 12.

Contact region 26 of the present invention comprises an array of alternating first and second spring arms 70,72 extending essentially in parallel forwardly from front portion 74 of plate section 46, with front plate portion 74 thus being intermediate contact region 26 and termination region 50 concluding in first and second free ends 76,78 respectively. First free ends 76 include arcuate portions 80 convex in a first direction shown upwardly in FIGS. 4 and 5, the upwardly facing surfaces of which define contact sections 82; second free ends 78 include arcuate portions 84 convex in an opposed second direction shown downwardly, the downwardly facing surfaces of which define contact sections 86; and contact sections 82,86 are preferably slightly radiused transversely. Rearwardly from arcuate portions 80,84 are offset portions 88,90 which are offset incrementally from the common general plane of spring arms 70,72.

Figure 5A:
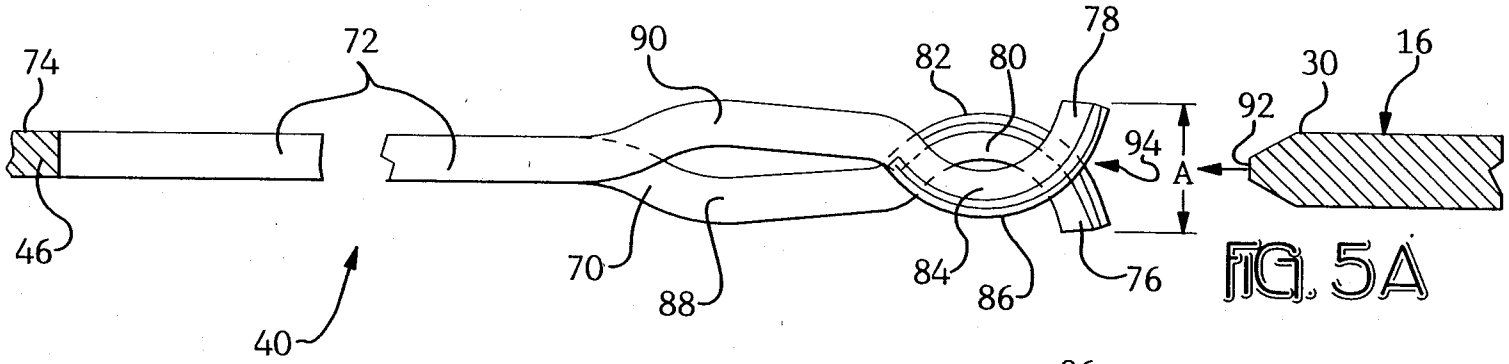
FIGS. 5A and 5B are enlarged partial elevation views of the mating end of the transition adapter of FIGS. 1 to 4 and the contact member of FIG. 1, showing mating therebetween.
Figure 5B:
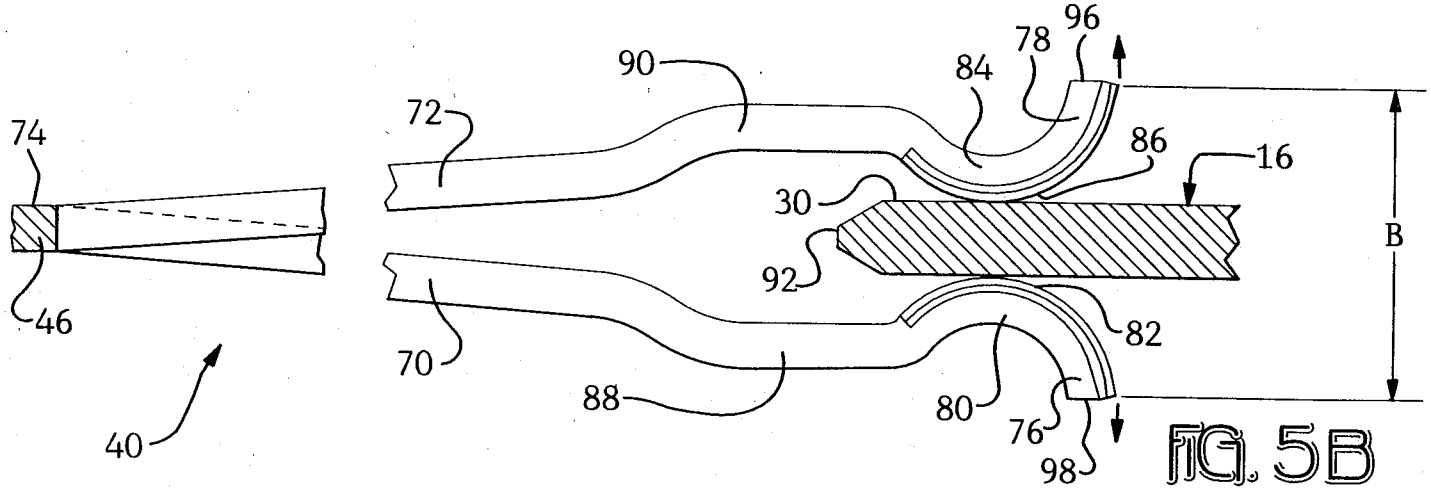

Referring to FIGS. 5A and 5B, transition adapter 40 for use with a mating blade-like contact member 16 has free ends 76,78 adapted to receive contact member 16 therebetween. Contact member 16 is preferably 0.025 inches thick and is shown having a continuous blade-shaped forward end preferably having no sharp edges. In use each of transition adapter 40 and contact member 16 are disposed in respective connector housings 14,18 respectively (FIG. 1), and the housings will initially engage and align themselves during mating, and as a result approximately align the transition adapter and the contact member. However, the planes of the transition adapter 40 and the contact member 16 may not be precisely coplanar but may be parallel an incremental vertical distance apart or may even be at a slight angle instead of parallel, and assurance of precise alignment of the mating elements must be provided by a lead-in mechanism of the mating elements themselves to avoid stubbing, mismating or damage upon mating. Free ends 76,78 extend forwardly and outwardly at an angle such as about 40° to 75° at their leading edges far enough to assure that the leading end 92 of contact member 16 which is disposed in any of a reasonably limited range of possible planes relative to the plane of transition adapter 40, is received between the rows of first and second spring arms 70,72. The height of blade receiving region 94 defined between extended length free ends 76,78 is indicated as A in FIG. 5A.

In FIG. 5B blade-like section 30 has been received between first and second spring arms 70,72 of transition adapter 40, and contact sections 82,86 are being urged against side surfaces of blade-like section 30 by deflected spring arms 70,72 with sufficient force to establish requisite contact normal force for a satisfactory low-loss electrical connection for transmission of electrical power. Spring arms 70,72 act as cantilever beams extending forwardly from front portion 74 of plate section 46. Upon full deflection of spring arms 70,72 leading edges 96,98 have been urged apart a distance indicated as B, which can be slightly reduced by beveling the outwardly extending edges of leading edges 96,98 as shown.

Transition adapter 40 with contact region 26 comprising a plurality of spring arms 70,72 extending from a single plate section permit precision stamping and forming techniques to control the mating interface, as contrasted with providing a pair of opposing plate sections from having arrays of opposing spring arms where the spacing between the plate sections is dependent, for instance, on the procedure of terminating the adapter to the flat cable or on variations in cable thickness. In the present embodiment, "opposing" spring arms extend from a common plate section, and the blade receiving area 94 defined thereby is independent of termination procedure, with upwardly facing contact sections 82 and downwardly facing contact sections 86 easily capable during manufacture of transition adapter 40 of being precisely aligned in "opposing" arrays in parallel planes a precisely controlled incremental distance apart. This precise arrangement permits in turn precise control over the electrical connection or interface upon mating with contact member 16, and resultant electrical performance across the interface, where the interface is separable and rematable. For instance, the relative distance between the first and second contact sections is not dependent upon variations in cable thickness, as it may easily be were the arrays of first and second spring arms on opposed plate sections. Also, placement of all spring arms on the same plate section would provide a simple structure which would eliminate a tendency of a blade member to pry apart the two plate sections from which the opposed spring arms extend, considering the spring bias from the significant contact normal force required for an assured electrical power connection.

In certain applications it may be desirable that distance B be kept to a minimum to maintain a low profile of the transition adapter 40 in its mated state, so that the connector housings 14,18 which must provide clearance for the deflected apart spring arm free ends need only have a corresponding low profile. However, it is also desirable that height A in FIG. 5A be large before mating to assure appropriate lead-in benefits which would tend to increase distance B after mating: the two objectives thus appear contradictory.

In FIGS. 6 to 8 and 9A to 9C are shown a second embodiment of monolithic contact member 100 of the present invention. Instead of a simple blade form at the leading edge as with contact member 16, forward region 102 of contact member 100 is formed into a plurality of first and second blade sections 104,106 corresponding to the first and second spring arms of the transition adapter with which they will engage upon mating to constitute the electrical connection. First blade sections 104 are angled to extend relatively upwardly, and second blade sections 106 are angled to extend relatively downwardly. Contact member is preferably stamped and formed from a strip of No. 197 copper, half hard, underplated with nickel and plated with silver and about 0.025 inches thick after plating. Posts 108 about 0.025 inches square extend from wider regions 110, and after insertion into a housing may be bent at right angles if desired for insertion into holes of a printed circuit panel for right angle mounting, or may be retained straight for vertical mounting, or may be provided with lands on their free ends for surface mounting.

Figures 9A, 9B, 9C:
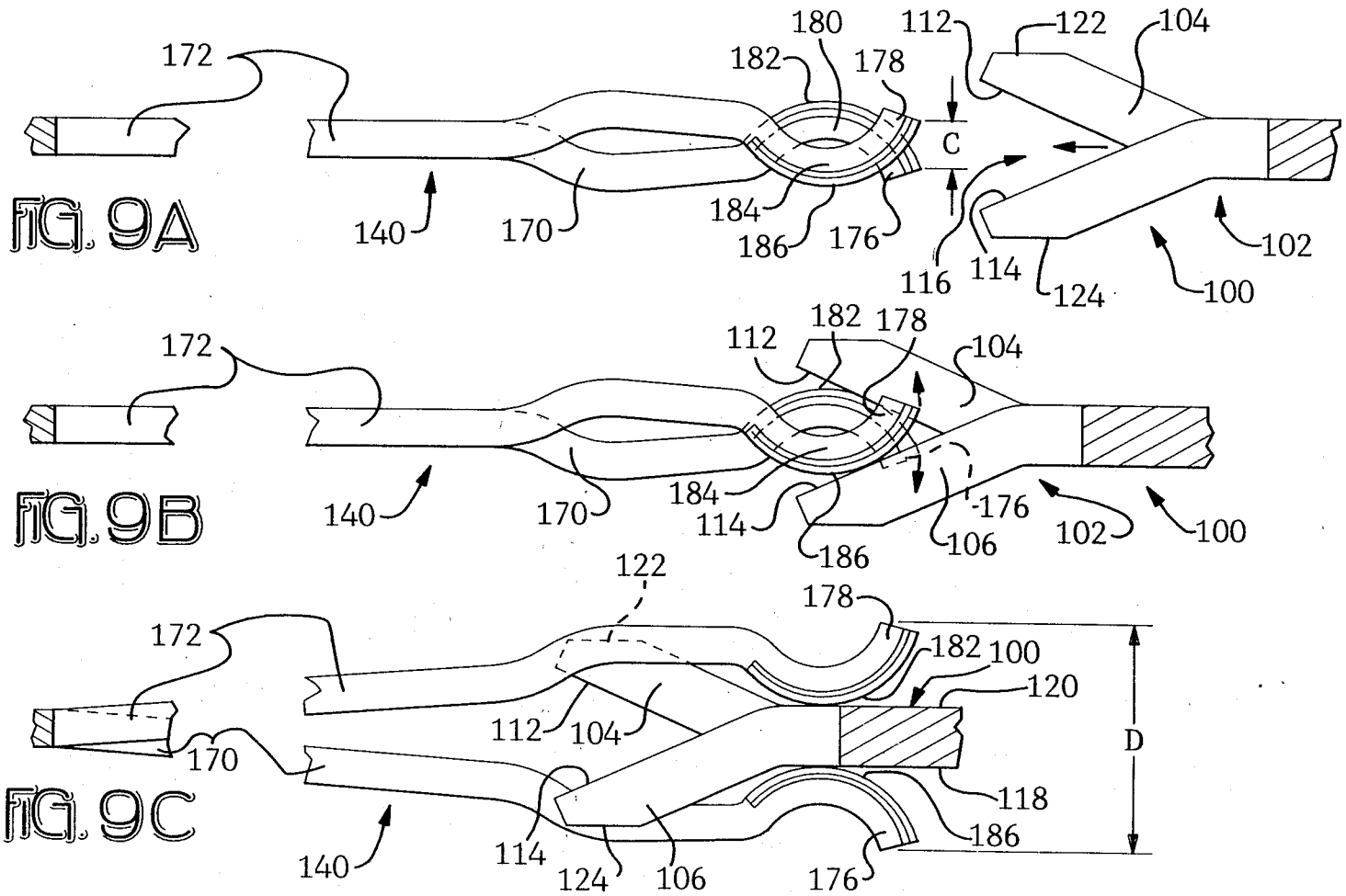
FIGS. 9A, 9B and 9C are enlarged partial elevation views of the mating ends of a second embodiment of transition adapter of the present invention and the contact member of FIGS. 6 to 8, showing mating therebetween.

Referring to FIGS. 9A to 9C, upwardly angled first blade sections 104 each present a downwardly and forwardly facing ramp 112 to be engaged by contact section 182 of free end 176 of a first spring arm 170 of transition adapter 140. Likewise, downwardly angled second blade sections 106 each present an upwardly and forwardly facing ramp 114 to be engaged by contact section 186 of free end 178 of a second spring arm 172 of transition adapter 140. Between ramps 112,114 is defined a cooperating lead-in region 116. Contact member 100 including a cooperating lead-in region 116 exempts the free ends 176,178 of spring arms 170,172 of transition adapter 140 from having an extended length to perform all necessary lead-in functions, and free ends 176,178 need only be long enough to continue the arcuate shape of arcuate portions 180,184 to present a curved surface for engagement against ramps 112,114 of blade sections 104,106. FIG. 9A illustrates the forward ends of transition adapter 140 and contact member 100 prior to and aligned for mating; in FIG. 9B, the curved surfaces of contact sections 182,186 begin to engage ramps 112,114.

In FIG. 9C, free ends 176,178 have been deflected outwardly by ramps 112,114 and are under spring bias against lower and upper surfaces 118,120 of contact member 00 respectively after full mating. Salient portions of free ends 176,178 at their forward edges define a distance D. Preferably outwardly extending edges of blade sections 104,106 have been chamfered to result in horizontal surfaces 122,124 after forming and reduce the height at their forwardmost ends by removing the Outwardly jutting edge; the distance between horizontal surfaces 122,124 should be no greater than distance D. Comparing FIG. 9C with FIG. 5B, distance D is noticeably less than distance B and results in a minimized after-mating profile, and a corresponding minimized profile in the connector housings.

Figure 10:
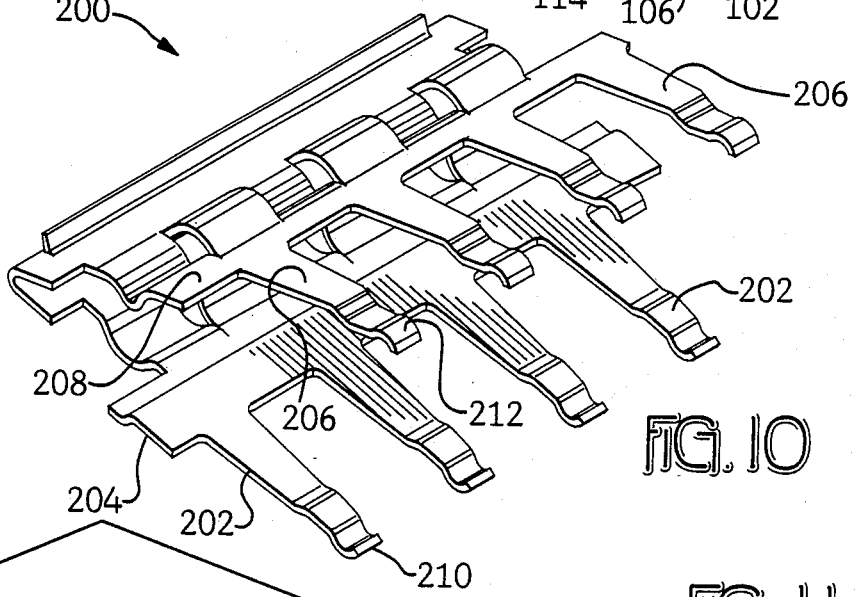
FIG. 10 illustrates a third embodiment of transition adapter, with spring arms on opposing plate sections.

Another embodiment of transition adapter is illustrated in FIG. 10, in which adapter 200 has first spring arms 202 extending forwardly from a first plate section 204, and second spring arms 206 extending forwardly from second plate section 208. First free ends 210 of first spring arms 202 are arcuately shaped convexly downward, and upon mating with a corresponding contact member such as member 100 of FIG. 8, will be deflected upwardly by ramped blades 106. Second free ends 212 of second spring arms 206 are arcuately shaped convexly upwardly to be deflected downwardly by ramped blades 104 of contact member 100. With first spring arms 202 being deflected upwardly and second spring arms 206 downwardly, first and second plate sections 204,208 will be urged tightly against each other by contact member 100 and not be pried apart.

Figure 8:
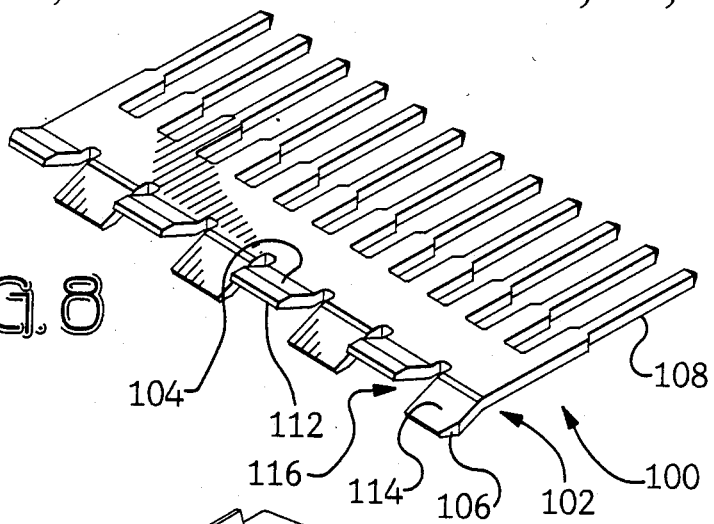

The embodiment of ramped contact member disclosed in FIGS. 6 to 8 contains an even number of ramped blade sections, corresponding to a like even number spring arms on the corresponding transition adapter 40 and 200 as shown in FIGS. 1 to 4 and FIG. 10, and thus has a "handedness" about it requiring coordinated manufacture of the two members for them to be matable, but which allows mating in either 180° orientation. Fabrication of a contact member similar to member 100 of FIG. 8 having an even number of ramped blades but with the upwardly and downwardly angled blades transposed, would prevent mating with a transition adapter whose first and second spring arms are as a shown in FIGS. 1 to 4 (and FIG. 10), and thus could produce a simple keying technique where mating with certain adapters and prevention of mating with others, is desired.

Figure 11:
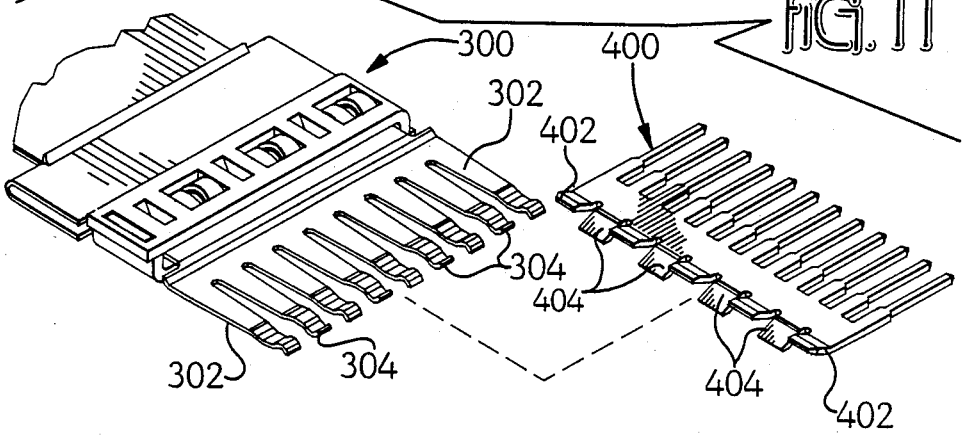
FIG. 11 shows embodiments of the transition adapter and contact member of the present invention having an odd number of spring arms and ramped blade sections respectively.

An odd number of ramped blades and spring arms may be utilized, such as nine, as shown in FIG. 11. Transition adapter 300 has five first spring arms 302, the outermost spring arms being first arms 302, deflectable downwardly by ramped blades 402 of contact member 400. There are four second spring arms 304 deflectable upwardly by ramped blades 404. In this arrangement polarization would result with mating permitted in only one of the two 180° orientations, possibly complicating assembly, but manufacture of the two parts would not require "handedness" coordination. In addition, with an odd number of ramped blades and spring arms, slightly improved performance is believed likely in that normal force between first spring arms 302 and contact member 400 and between second spring arms 306 and contact member 400, is likely to be uniform among like spring arms. Since downwardly deflectable spring arms are symmetically spaced in location proceeding outwardly from the center, and upwardly deflectable spring arms are also symmetically spaced from the center, the net relative torque is zero between transition adapter 300 and contact member 400. Among the spring arms of an even number (such as eight) where the spring arms alternate along the upper and lower sides and are spaced offset relative to the center axis, there is a tendency of the relatively offset spring arms to apply a relative slight torque to the blade member, and the forces on the individual spring arms is likely to be incrementably different. The use of both even- and odd-numbered spring arm transition adapters (and also contact members if they have ramped blade sections) in a large assembly could provide a manner of visible differentiation between power connections and ground connections.

Variations may occur to the skilled artisan which are within the spirit of the invention and the scope of the claims.

What is claimed is:

1. A transition adapter for termination to a flat cable for providing an electrical interface with another electrical article, comprising:

a metal member having a termination section, a plate section extending from said termination section, and a plurality of first and second spring arms coextending from said plate section outwardly from said termination section, said first spring arms including first free ends extending forwardly and outwardly from the plane of said plate section in a common first direction, and said second spring arms including second free ends extending forwardly and outwardly from the plane of said plate section in a common second direction, said first and second free ends defining a region adapted for receiving a blade-like contact member therebetween for mating and establishing an electrical interface therewith, whereby during mating with the contact member said first free ends engage the contact member and initiate the deflection of said first spring arms in said first direction by the contact member and said second free ends engage the contact member and initiate the deflection of said second spring arms in said second direction.

2. A transition adapter as set forth in claim 1 wherein the total number of said first and second spring arms is an odd integer.

3. A transition adapter as set forth in claim 1 wherein the total number of said first and second spring arms is an even integer.

4. A transition adapter as set forth in claim 1 wherein said first and second spring arms alternate.

5. A transition adapter as set forth in claim 1 wherein said first free ends extend forwardly from first arcuate portions of said first spring arms, said first arcuate portions being convex in said second direction and defining first contact sections along convex surface portions thereof engageable with the contact member upon mating, and said second free ends extend forwardly from second arcuate portions of said second spring arms, said second arcuate portions being convex in said first direction and defining second contact sections along convex surface portions thereof engageable with the contact member upon mating.

6. A transition adapter as set forth in claim 5 wherein said first and second arcuate portions are slightly radiused transversely along respective convex surface portions thereof.

7. A transition adapter as set forth in claim 5 wherein said first spring arms include first offset portions rearwardly of said first arcuate portions formed offset out of the plane of said plate section a slight distance in said first direction, and said second spring arms include second offset portions rearwardly of said second arcuate portions formed offset out of the plane of said plate section a slight distance in said second direction.

8. A transition adapter as set forth in claim 5 wherein said first and second free ends project a selected length forwardly and outwardly from said first and second arcuate portions respectively to define an assured lead-in for receiving the blade-like contact member thereinto.

9. A transition adapter for termination to a flat cable for providing an electrical interface with another electrical article, comprising:

a metal member having a termination section, a first plate section extending from said termination section having a plurality of first spring arms extending therefrom outwardly from said termination section, and a second plate section extending from said termination section substantially parallel to and opposed from said first plate section and having a plurality of second spring arms extending therefrom outwardly from said termination section and spaced to alternate with said first spring arms, said first spring arms including first free ends extending forwardly and outwardly from the plane of said first plate section in a common first direction and concluding beyond said second plate section after cable termination, and said second spring arms including second free ends extending forwardly and outwardly from the plane of said second plate section in a common second direction and concluding beyond said first plate section after cable termination, said first and second free ends defining a region adapted for receiving a blade-like contact member therebetween for mating and establishing an electrical interface therewith, whereby during mating with the contact member said first free ends engage the contact member and the deflection of said first spring arms is initiated in said first direction by the contact member and said second free ends engage the contact member and the deflection of said second spring arms is initiated in said second direction so that said first and second plate sections are urged toward and against each other.

10. A contact member for mating with a transition adapter terminated to a flat cable, comprising:

an integral metal member having a body section, a plurality of contact sections extending rearwardly from said body section for electrical connection with corresponding contact sections of an electrical article, and a blade contact section extending forwardly from said body section to be received between first and opposing second spring arms of a transition adapter for establishing an electrical interface therewith, whereby the contact member provides sufficient metal cross-section to yield low electrical resistance for satisfactorily transmitting electrical power from a flat cable to a plurality of contact sections of the electrical article.

11. A contact member as set forth in claim 10 wherein the forward edge of said blade contact section is transversely continuous.

12. A contact member as set forth in claim 10 for a transition adapter including first and second spring arms extending forwardly therefrom having first and second free ends defining a receptacle adapted to receive a contact member thereinto where the first and second spring arms are adapted to be deflected in respective opposed first and second directions upon mating, wherein said blade contact section comprises a plurality of first and second blade sections associated with respective ones of the first and second spring arms, said first blade sections extending forwardly and being angled outwardly in said second direction to define first ramps facing said first direction to initially engage first free ends of the first spring arms and initiate deflection of the first spring arms in the first direction, and said second blade sections extending forwardly and being angled outwardly in said first direction to define second ramps facing said second direction to initially engage second free ends of the second spring arms and initiate deflection of the second spring arms in the second direction, whereby the forward edges of the first and second free ends of the first and second spring arms need not be spaced a substantial distance apart prior to mating for lead-in purposes and therefore will present a low vertical profile upon spring arm deflection after mating.

13. A contact member as set forth in claim 12 wherein outwardly extending edges of said first and second blade sections are chamfered to define horizontal surfaces reducing the vertical profile of the contact member.

14. A matable assembly of a transition adapter for termination to a flat cable and a contact member for providing an electrical interface with another electrical article, comprising:

a metal member having a termination section, a plate section extending from said termination section, and a plurality of first and second spring arms coextending from said plate section outwardly from said termination section, said first spring arms including first free ends extending forwardly and outwardly from the plane of said plate section in a common first direction, and said second spring arms including second free ends extending forwardly and outwardly from the plane of said plate section in a common second direction, said first and second free ends defining a contact-receiving region; and a contact member comprising an integral metal member having a body section, a plurality of contact sections extending rearwardly from said body section for electrical connection with corresponding contact sections of an electrical article, and a blade contact section extending forwardly from said body section to be received into said contact-receiving region of said transition adapter for establishing an electrical interface therewith, said contact-receiving region being adapted for receiving said blade-like contact member therebetween for mating and establishing an electrical interface therewith, whereby during mating with the contact member said first free ends engage said contact member and initiate the deflection of said first spring arms in said first direction by said contact member and said second free ends engage said contact member and initiate the deflection of said second spring arms in said second direction.

15. A matable assembly as set forth in claim 1 wherein the forward edge of said blade contact section is transversely continuous.

16. A matable assembly as set forth in claim 14 wherein said blade contact section comprises a plurality of first and second blade sections associated with respective ones of the first and second spring arms, said first blade sections extending forwardly and being angled outwardly in said second direction to define first ramps facing said first direction to initially engage first free ends of the first spring arms and initiate deflection of the first spring arms in the first direction, and said second blade sections extending forwardly and being angled outwardly in said first direction to define second ramps facing said second direction to initially engage second free ends of the second spring arms and initiate deflection of the second spring arms in the second direction, whereby the forward edges of the first and second free ends of the first and second spring arms need not be spaced a substantial distance apart prior to mating for lead-in purposes and therefore will present a low vertical profile upon spring arm deflection after mating.

17. A matable assembly as set forth in claim 16 wherein outwardly extending edges of said first and second blade sections are chamfered to define horizontal surfaces reducing the vertical profile of the contact member.

18. A matable assembly of a terminal and a contact member providing a separable interface, the terminal having a termination section, and intermediate section and a contact region forwardly of the intermediate section, and the contact member comprising a body section, a rearward contact region rearwardly of the body section and a forward contact region forwardly of the body section, the terminal contact region separably matable with the forward contact region of the contact member, one of the terminal contact region and the second contact region of the contact member including a plurality of spring arms having contact sections on free ends thereof, characterized in that:

one of said terminal and said contact member has said plurality of spring arms having first spring arms including respective first free ends extending forwardly and outwardly from a plane of one of said intermediate section and said body section respectively, in a common first direction, and second spring arms including respective second free ends extending forwardly and outwardly from said plane in a common second direction, said first and second free ends defining a contact-receiving region; and the other of said terminal and said contact member including a blade-like section defining outwardly facing contact surfaces associated with said first and second free ends upon mating, and said contact-receiving region defined by said first and second free ends adapted to receive said blade-like section thereinto, whereby during mating with said blade-like section said first free ends engage therewith and initiate the deflection of said first spring arms in said first direction and said second free ends engage therewith and initiate the deflection of said second spring arms in said second direction.

19. A matable assembly as set forth in claim 18 further characterized in that said first free ends extend forwardly from first arcuate portions of said first spring arms, said first arcuate portions being convex in said second direction and defining first contact sections along convex surface portions thereof engageable with said blade-like section upon mating, and said second free ends extend forwardly from second arcuate portions of said second spring arms, said second arcuate portions being convex in said first direction and defining second contact sections along convex surface portions thereof engageable with said blade-like section upon mating.

20. A matable assembly as set forth in claim 19 further characterized in that said blade-like section includes a plurality of first and second blade sections associated with respective ones of said first and second spring arms, said first blade sections extending forwardly and being angled outwardly in said second direction to define first ramps facing said first direction to initially engage said first free ends of said first spring arms and initiate deflection of said first spring arms in said first direction, and said second blade sections extending forwardly and being angled outwardly in said first direction to define second ramps facing said second direction to initially engage said second free ends of said second spring arms and initiate deflection of said second spring arms in said second direction, whereby the forward edges of the first and second free ends of the first and second spring arms need not be spaced a substantial distance apart prior to mating for lead-in purposes and therefore will present a low vertical profile upon spring arm deflection after mating.

* * * * *